US005779047A

United States Patent [19]

Darrah

[11] Patent Number: 5,779,047

[45] Date of Patent: Jul. 14, 1998

[54] WATER TIGHT STEEL TOOL BOX

[76] Inventor: Scott A. Darrah, 7616 Wilderness Rd., Raleigh, N.C. 27613

[21] Appl. No.: 823,712

[22] Filed: Mar. 25, 1997

[51] Int. Cl.[6] ..... B65D 85/00

[52] U.S. Cl. ..... 206/373; 206/349; 220/469

[58] Field of Search ..... 206/349, 373–375; 220/466, 469

[56] References Cited

U.S. PATENT DOCUMENTS

| | | | |
|---|---|---|---|
| 3,777,882 | 12/1973 | McIntyre | 206/372 |
| 4,340,140 | 7/1982 | Wilcox et al. | 206/373 |
| 4,674,665 | 6/1987 | Van Kirk | 206/349 |
| 4,832,193 | 5/1989 | Kime | 206/373 |
| 4,938,355 | 7/1990 | Rocco | 206/373 |
| 5,114,007 | 5/1992 | Chen | 206/373 |
| 5,641,066 | 6/1997 | Mascaro | 206/372 |

*Primary Examiner*—Paul T. Sewell
*Assistant Examiner*—Luan K. Bui
*Attorney, Agent, or Firm*—Rhodes, Coats & Bennett L.L.P.

[57] ABSTRACT

A steel tool box that is encapsulated in a polyethylene shell comprising of a base unit and a two piece drop front lid unit, which when closed and locked provide an air and water tight shell over the steel working area. The inner steel walls holding the drawer sliding and hanging fixtures are molded into the inner plastic walls of the base through a modified rotational molding process. Weight is significantly reduced by eliminating the outside steel walls of conventional steel tool boxes. This is possible through the modified molding process of parts into plastic.

2 Claims, 4 Drawing Sheets

14
13
11
12
15
16

5
32
1
2
4
6
3

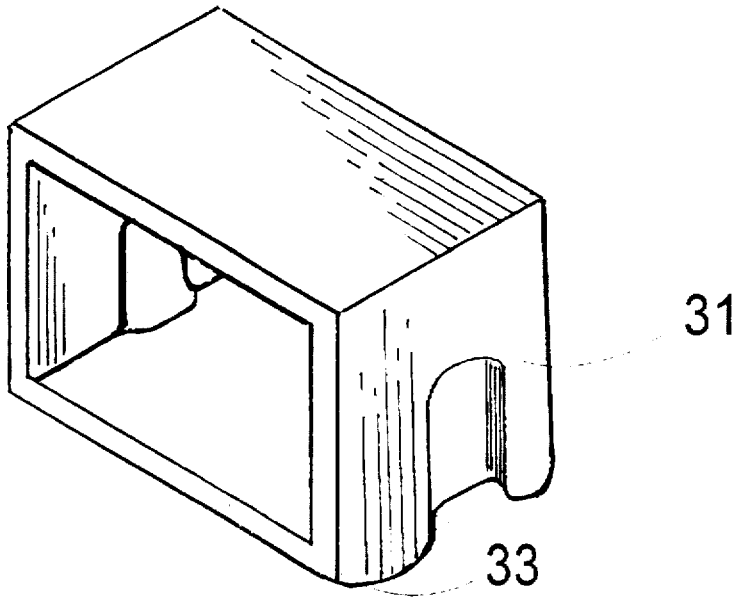
Fig. 4
Fig. 5
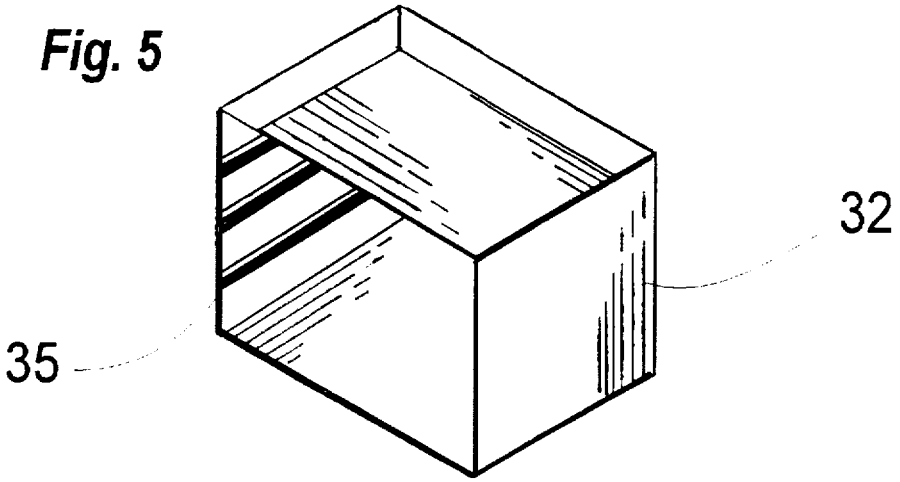
Fig. 6
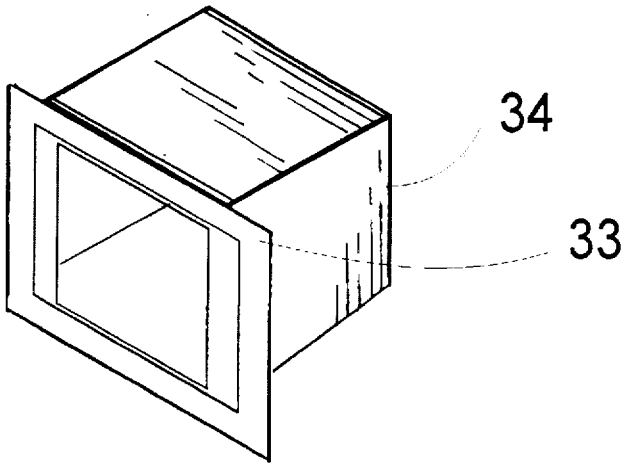

32
32
35

WATER TIGHT STEEL TOOL BOX

FIELD OF THE INVENTION

This invention relates to an improved cold rolled steel tool box commonly used in road service applications, and particularly to the polyethylene encapsulating portion of said tool box which provides a protective and cushioning element to the steel components. The improved tool box contains steel drawers that operate on conventional channel-slide mechanisms but, unlike conventional box construction, the drawer channels are bonded to the plastic side walls of the polyethylene protective case. The protective polyethylene case consists of a base unit component and a two part drop-front lid component, joined in a tongue and groove manner in order to provide an airtight and/or water tight seal when closed.

BACKGROUND OF THE INVENTION

The need for a weather resistant storage container with which to transport tools and critical equipment to and from "on site" service jobs is well known. Such a product is specifically needed in the automotive, marine, aircraft, construction and military environments as well as many others not named in this document. To date this function has been performed through the use of canvas bags, wooden tote trays, and, more recently, with the use of steel or aluminum road service boxes and plastic container tubs of all types. All such products and methods are well known, and are commonly utilized but do not totally satisfy the functional needs of this type of product. Both steel and plastic have certain advantageous characteristics as materials for this product application, but neither can perform unilaterally the function of the other.

In most instances all of these various types of tool storage and tool transport containers are inadequate in one or more ways. All steel tool boxes are made of spot welded cold rolled steel construction and are painted with a protective coating of baked enamel or powder coat epoxy. While this coating affords some protection in the environment to be served, it is limited. The road service, construction or marine service environments destroy such protective coatings in relatively short periods of time resulting in rusting of the steel components and eventual failure of the spot welded parts. In addition, the road shock and vibration experienced in transporting tool boxes to and from the work site puts tremendous stress on these same spot weld which also causes eventual failure. Premature failure will almost always occur in the event of overloading of the tool box in this environment, and is most commonly experienced with drawer collapse off of the welded channels from the false side or inside wall of the tool box.

In order to correct some of the above problems, many manufacturers have resorted to increasing the gauge (thickness) of the steel panels and double spot welding and arc welding of critical areas of common failure. While this does improve the useful life of the product, it, also, substantially increases the weight and cost of the end product. In fact, recent new steel road boxes offered in the market are so heavy when loaded with tools and equipment that a tow motor is required to load and unload the road box from the vehicle. Consequently, the road box loses the feature of portability. Most steel tool boxes do, however, provide an important feature not found in plastic tubs and portable boxes, and that is drawers. All professional technicians will stress the need for drawers in order to provide organization and storage of high cost tools and equipment.

As mentioned, the biggest failure of plastic storage products to perform the road service organization and storage function is the lack of drawers. Due to the fact that most all plastic storage units available in today's market are manufactured in single wall construction, the attachment of drawer slides and/or other hardware to accommodate the installation of drawers without weakening the container is impossible. Furthermore, with such attachments on single wall construction, the container is opened with holes such as to allow the entry of dust and water into the interior cavity. Finally, conventional injection molded and blow molded containers such as tubs and garbage containers have a short life span in the harsh environment of road service work.

Accordingly, it is the object of this invention to provide an improved road service tool box which provides the same organization and storage features as is found in cold rolled steel tool boxes, is cushioned and insulated against road shock and weather elements through a polyethylene encapsulation, and is light enough when loaded with tools to move on and off the work site.

In the preferred embodiment of the invention, the steel liner with welded drawer slide channels is molded into the inner wall of the polyethylene base unit. The drawers are attached to the steel slide channels and the entire steel tool box is sealed air and water tight when the lid and drop front portion are closed and latched. By molding the steel sleeve into the inner wall of the polyethylene base, the weight of the steel portion is reduced by 40%.

Other objects, features and advantages will become more fully apparent from the following detailed description of the preferred embodiment and the accompanying drawings.

BRIEF DESCRIPTION OF THE DRAWINGS

FIGS. 4–6 are illustrations of the modified rotational molding process that has been modified and improved to allow a steel sleeve insert to be molded into inner wall of plastic base. As illustrated in FIG. 5, the steel sleeve insert is equipped with welded drawer channels.

DETAILED DESCRIPTION OF THE PRESENT INVENTION

Figure 1:
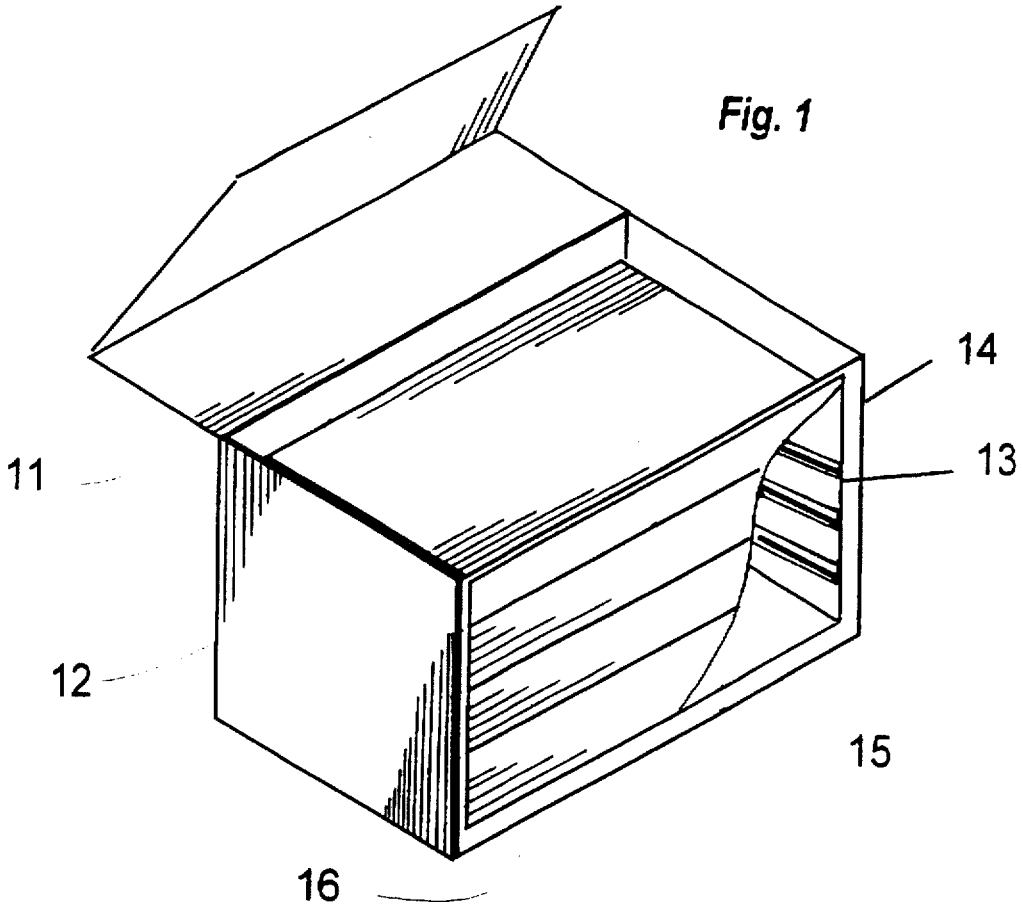
FIG. 1 is an illustration of the prior art of an all steel road service tool box or container described hereinabove.

Referring to FIG. 1, there is illustrated a common cold rolled steel road-service tool box or container 12 with a protective drop front lid 11. As illustrated the tool box consists of a base unit 12 and a two piece drop front lid assembly 11, which when closed and locked, cover and protect a series to tool organization and storage drawers 16. The number of drawers can vary in size depending on the number of drawer channels welded into the "false side" or inner wall 13. The normal method of construction for this type of tool box requires that a "false side" or inner wall 13 be assembled after welding, forming and painting of the base unit 12. The "false side" or inner wall is welded with drawer slide channels 15 which allow for assembly of drawer units 16. The assembly of the "false side" or inner wall is normally accomplished as a press fit into both right and left sides of base unit 12. This method avoids unsightly welding directly to outside wall 14. All cold rolled steel parts are sheared, notched, formed and welded before being degreased in zinc phosphate and painted in baked enamel or powder coat. This method of manufacturing is suitable in providing drawers for tool organization and storage; it is not suitable for road service work. All cold rolled steel tool boxes will eventually rust and spot welds will fail due to weather elements and road shock that weakens all formed and welded joints in the tool box construction.

Figure 2:
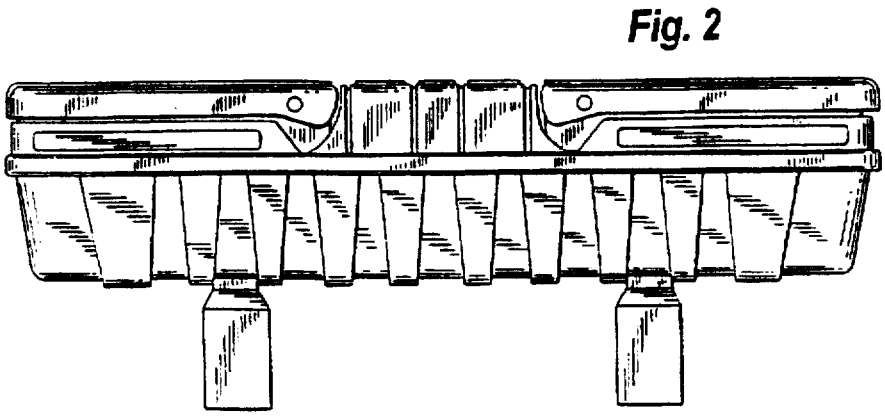
FIG. 2 is an illustration of the prior art of an all plastic road service tool box or container described hereinabove.

Refer now to FIG. 2 that illustrates a typical formed plastic road-service tool and equipment storage box or container. Not unlike a steel road-service tool box, the plastic tool box has a lid member 21 and a base member 22 which are separate but are joined together at the top of the base and the bottom of the lid by tongue and groove portions respectively. The groove supports a gasket therein so that when the lid 21 is positioned over the base 22, the tongue and grooves mate with one another to form an air tight and water tight seal. In this tool box container the outside wall 24 is constructed as a single wall which is standard in the injection molding process and vacuum forming . While the tongue and groove with gasket feature can be readily formed through the injection molding process, a double wall can not. This is disadvantageous due to the fact that the installation of any hardware or fasteners with which to attach drawer channels will eliminate the protective air and water tight features by putting holes into a previously sealed container. A double wall construction method would allow for use of the tongue and grooved sealing feature of plastic molding and the installation of drawer channels without destroying the air and water tight integrity of such a molded product. This is preferably accomplished through the use of a rotational molding process known in the art.

Figure 3:
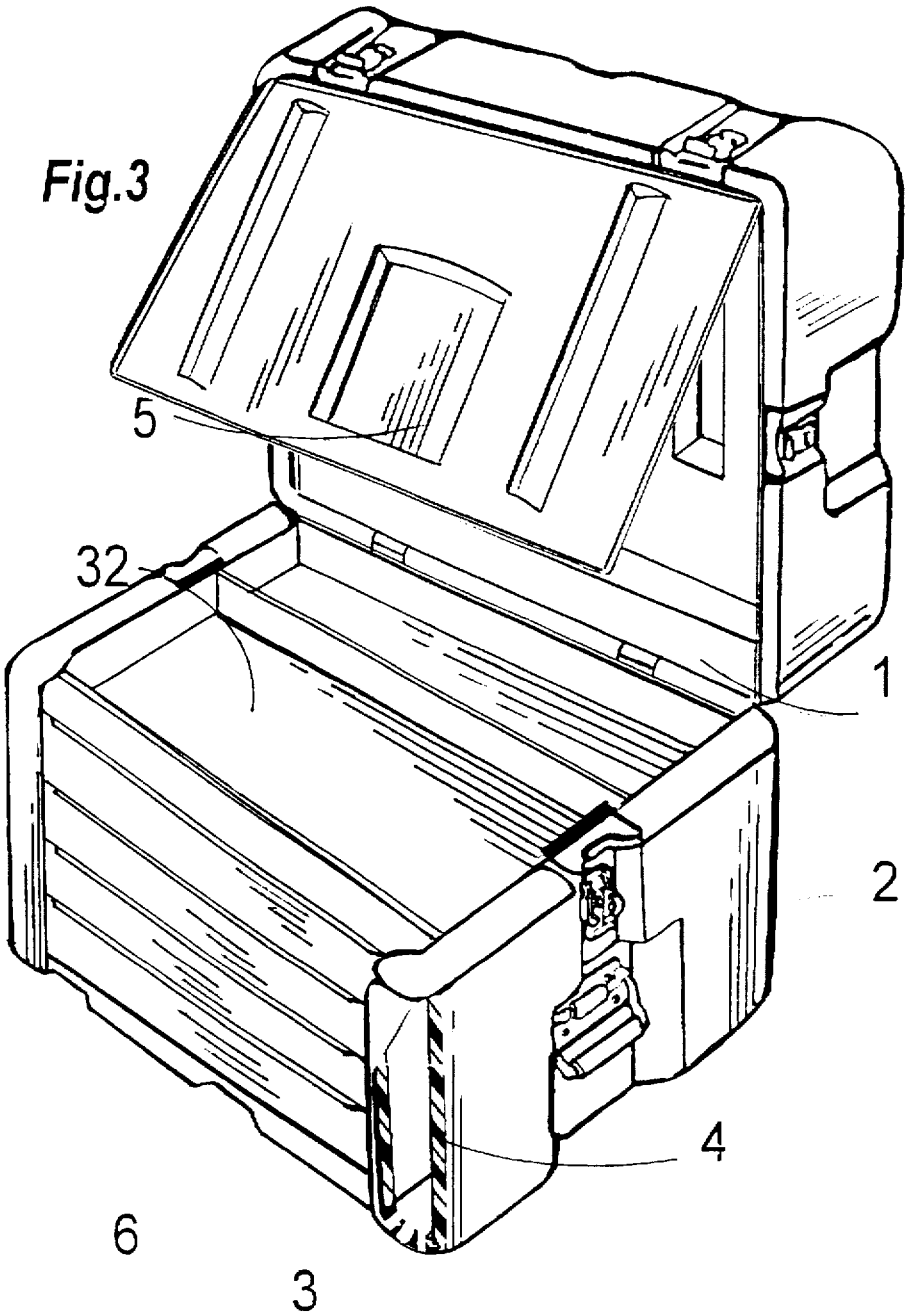
FIG. 3 is an illustration of the preferred embodiment of the invention showing the all steel tool box encapsulated, as an inner liner component, in an all plastic base, lid and drop front cover. Also shown is a section view of base container double wall construction.

FIG. 3 illustrates therein an air and water tight tool box or container 10 according to the present invention. This tool box 10 is made by utilizing a process of combining a cold rolled steel insert sleeve 32 into a rotationally molded container base 2 featuring double wall construction as in section 4. The steel sleeve insert 32 is molded into the inner wall 3 of the container base 2. This has been accomplished by modifying a conventional female mold component FIG. 4 and its counterpart female mold component FIG. 6 to accept an additional and new mold component FIG. 5 that slides onto male mold component FIG. 6. The mold is then assembled. The sleeve component remains with the finished molded polyethylene part after completion of the molding cycle and is replaced with each new part to be cycled. Otherwise, the rotationally molded outside case which encapsulates the cold rolled steel component has many of the same features as a conventional plastic molded container, and from the outside, when closed, would appear to be the same as any conventional plastic container FIG. 2

As illustrated in FIG. 3, the preferred embodiment of the invention has a plastic base component 2 with tongue portion of tongue and groove molded into top portion; a plastic lid component 1, and, a plastic drop front cover Component 5, both with groove portion of tongue and groove molded in order to seal with tongue portion upon closure. The groove portions of all plastic parts are equipped with pliable gaskets to assure air and water tight sealing. The steel sleeve component 32 is molded into inner walls of base 2 which allows for assembly of cold rolled steel drawers 6 into an all plastic container 2. The use of double wall construction 4, as available through rotational molding, provides an insulating and cushioning feature to the overall embodiment. This feature protects the steel components from weathering and road shock deterioration of the parts and construction of the parts therein.

Refer now to FIGS. 4, 5 and 6, where the steel sleeve insert 32 is illustrated in FIG. 5 as an independent part of the rotational mold set. FIG. 4 is an illustration of the female mold component of the rotational mold set. The female mold component forms the outside wall 31 of the molded base unit of the tool box as described hereinabove. This mold FIG. 4 is attached through fasteners 33 to the male mold component FIG. 6 of the rotational mold set again through fasteners 33. The male mold FIG. 6 forms the inner wall 34 of the molded base of the tool box as hereinabove described. FIG. 5 is equipped with welded drawer channels 35. The steel sleeve FIG. 5 is attached to FIG. 6 by sliding over the protruding portion of the male mold component FIG. 6, prior to assembly with FIG. 4, the female mold assembly. Upon closure the combined parts of the rotational mold, FIGS. 4, 5 and 6 are entered into the rotational molding cycle. During the plastic forming cycle, the steel sleeve becomes molded into the inner wall of the finished molded base unit, wherein, upon disassembly of the mold and removal of the molded base unit part, the steel sleeve remains with the molded base unit as a permanent part. At the same time, the sleeve parts from the male and female portions of the rotational mold and is replaced with the mold preparation for the next manufacturing cycle.

Figure 7:
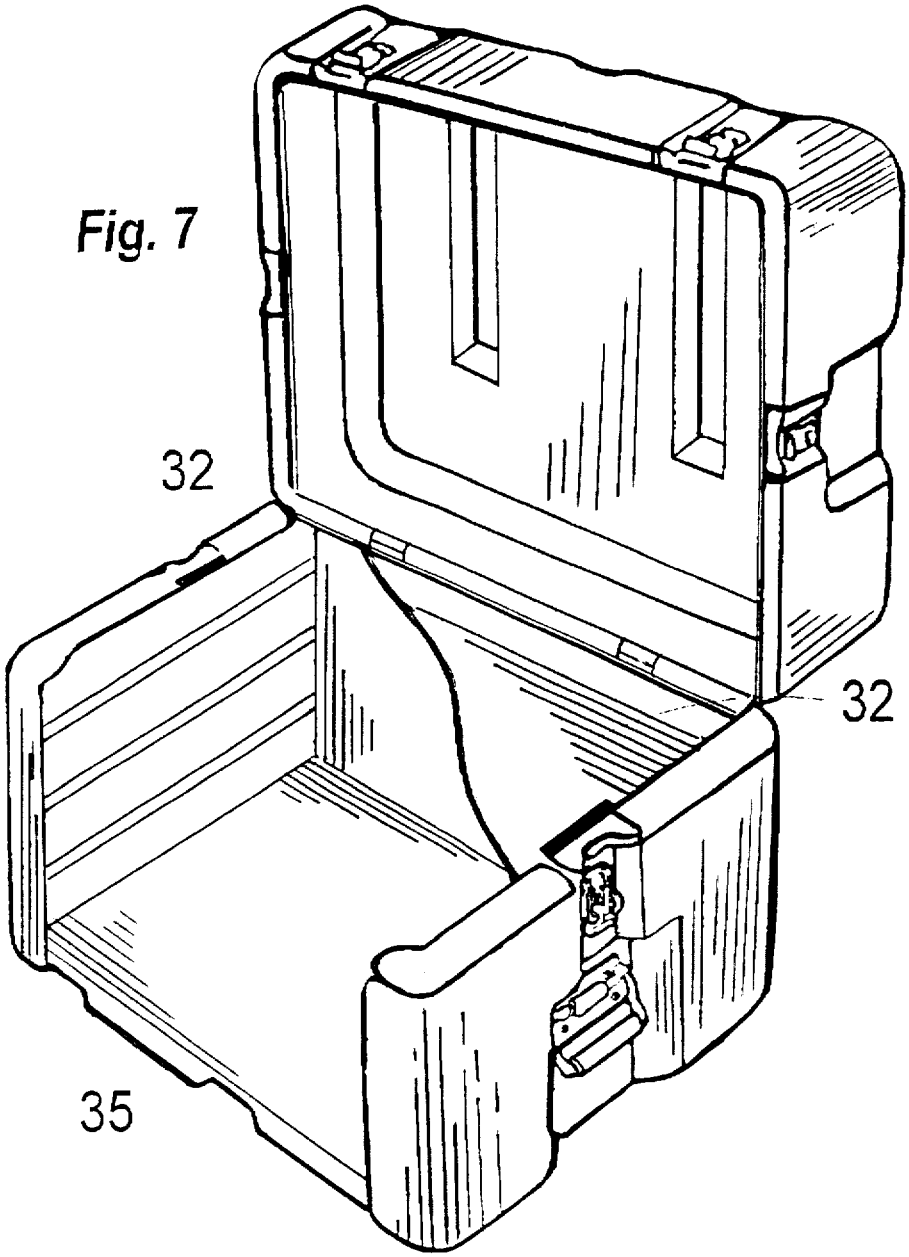
FIG. 7 is a section illustration of the molded polyethylene base unit showing the steel sleeve as an integral part of the molded polyethylene base unit. The steel sleeve is equipped with welded drawer channels and is ready for assembly of sliding drawers.

FIG. 7 is a section view of the invention less the drop front lid and the steel tool drawers, for the purpose of viewing the finished product prior to assembly of drop front lid and drawers. In this drawing, the steel sleeve component 32 is seen after removal from the rotational molds. The drawer channels 35 are seen as being permanent fixtures to the side walls in the molded base unit. This has been accomplished without the use of drilled holes, steel fasteners, or glue, thus preserving the air and water tight integrity of the toll box invention. When assembled with drawers, and closed using the molded top lid and drop front lid, the tool box invention is lightweight, airtight, water tight and insulated with cushioning affect ; all of which increases the useful life of the product.

While the present invention has been disclosed in connection with a preferred embodiment thereof, it should be appreciated that there may be other embodiments which fall within the spirit and scope of the invention as described. For example, the double-wall structure could be formed of solid and insulated walls rather than hollow walls and could be formed of other moldable material as desired. In the preferred embodiment polyethylene is used, however, other materials could also be used.

The embodiments of the invention in which an exclusive property or privilege is claimed are defined as follows:

1. A water tight steel box consisting of:

a polyethylene base member having a bottom and sidewalls, said sidewalls being of a hollow double wall construction and plastic lid members with at least one of said lid members having a top and sidewalls, said sidewalls of said at least one of said lid members being of a hollow double wall construction and having inside and outside portions, said lid and base members having mating raised tongue and recessed groove portions at open ends of said lid and base sidewalls;

a gasket fitted in said groove portions;

a cold rolled steel inner liner with welded drawer channels molded into said sidewalls of said base member; and said drawer channels configured to accept cold rolled steel drawers; and a locking means for holding said lid members against said base member, whereby said liner and base member eliminates need for double steel walls to support steel drawers, and whereby the tongue and groove configurations of said base and lid members encapsulate and protect inner steel components by sealing same when in closed and locked position, and whereby said liner allows for installation of steel welded parts without drilling of holes in order to attach fasteners to support steel drawers.

2. The steel tool box according to claim 1, wherein said inner liner and said base member being integral.

* * * * *